US007494021B2

(12) United States Patent
Yang et al.

(10) Patent No.: US 7,494,021 B2
(45) **Date of Patent: *Feb. 24, 2009**

(54) TRASH CAN ASSEMBLY WITH MOTION DAMPER FOR LID

(75) Inventors: Frank Yang, Rancho Palos Verdes, CA (US); Joseph Sandor, Santa Ana Heights, CA (US)

(73) Assignee: simplehuman, LLC, Torrance, CA (US)

( * ) Notice: Subject to any disclaimer, the term of this patent is extended or adjusted under 35 U.S.C. 154(b) by 575 days.

This patent is subject to a terminal disclaimer.

(21) Appl. No.: 11/086,932

(22) Filed: Mar. 22, 2005

(65) Prior Publication Data

US 2006/0213910 A1 Sep. 28, 2006

(51) Int. Cl.
*B65D 43/26* (2006.01)
*B65D 51/04* (2006.01)

(52) U.S. Cl. ..... 220/264; 220/263; 220/908; 220/23.83; 220/845

(58) Field of Classification Search ..... 220/810, 220/264, 263, 908, 23.8
See application file for complete search history.

(56) References Cited

U.S. PATENT DOCUMENTS

| | | | | |
|---|---|---|---|---|
| 2,946,474 | A | 7/1960 | Knapp | |
| 3,891,115 | A | 6/1975 | Ono | |
| 4,014,457 | A | 3/1977 | Hodge | |
| 4,630,332 | A | 12/1986 | Bisbing | |
| 4,765,548 | A | 8/1988 | Sing | |
| 5,170,904 | A | 12/1992 | Neuhaus | |
| 5,213,272 | A * | 5/1993 | Gallagher et al. | 241/33 |
| 5,322,179 | A | 6/1994 | Ting | |
| 5,348,222 | A | 9/1994 | Patey | |
| 5,385,258 | A | 1/1995 | Sutherlin | |
| 5,471,708 | A | 12/1995 | Lynch | |
| 6,000,569 | A | 12/1999 | Liu | |
| 6,010,024 | A | 1/2000 | Wang | |
| 6,024,238 | A | 2/2000 | Jaros | |
| 6,036,050 | A | 3/2000 | Ruane | |
| 6,209,744 | B1 | 4/2001 | Gill | |
| 6,386,386 | B1 | 5/2002 | George | |
| 6,390,321 | B1 | 5/2002 | Wang | |
| 6,401,958 | B1 | 6/2002 | Foss et al. | |

(Continued)

FOREIGN PATENT DOCUMENTS

| | | |
|---|---|---|
| DE | 1610087 | 7/1950 |

(Continued)

OTHER PUBLICATIONS

Trento Corner 23 Trash Can, Hailo product brochure. http://www.hailo.de/html/default.asp?site=12_71_107&lang=en.

*Primary Examiner*—Robin Hylton
(74) *Attorney, Agent, or Firm*—Knobbe, Martens, Olson & Bear, LLP

(57) ABSTRACT

A trash can assembly has an outer shell having an enclosing wall, a top end, and a bottom end. The assembly includes a pedal bar pivotably coupled to the bottom end, a lid pivotably coupled to the top end, and a lifting rod that extends vertically inside the outer shell, with the lifting rod coupling the lid and the rear end of the pedal bar. An air damper is provided inside the outer shell and coupled to the rear of the pedal bar for applying an opposing force against the downward motion of the rear of the pedal bar.

5 Claims, 4 Drawing Sheets

U.S. PATENT DOCUMENTS

| | | | | |
|---|---|---|---|---|
| 6,626,317 | B2 | 9/2003 | Pfiefer et al. | |
| 6,981,606 | B2 * | 1/2006 | Yang et al. | 220/23.87 |
| 2003/0201267 | A1 | 10/2003 | Yang et al. | |
| 2004/0164077 | A1 | 8/2004 | Kuo | |

FOREIGN PATENT DOCUMENTS

| | | |
|---|---|---|
| DE | 1283741 | 7/1966 |
| EP | 1094017 | 4/2001 |
| EP | 1136393 | 4/2004 |
| NL | 6 908 550 | 12/1970 |

* cited by examiner

TRASH CAN ASSEMBLY WITH MOTION DAMPER FOR LID

BACKGROUND OF THE INVENTION

1. Field of the Invention

The present invention relates to trash can assemblies, and in particular, to a trash can assembly that has a mechanism for slowing the closing motion of the lid.

2. Description of the Prior Art

A major concern for both the home and the workplace is containing and holding wastes, refuse, and trash until permanent disposal. Trash cans act as containers for holding trash and other wastes that are produced in any typical home or office. Trash and garbage cans often employ lids and covers to contain the trash and its associated odor, to hide the trash from view, and to prevent the trash from contaminating areas beyond the lid.

Conventional trash cans have been improved over the years to make them more user-friendly, sanitary, and hygienic. For example, many trash cans are now provided with a foot pedal positioned adjacent the base of the trash can so that a user can step on the foot pedal to open the lid of the trash can, thereby freeing up the user's hands to deposit trash, or to change the plastic liner or bag that is used to line the trash can. Other trash cans have even provided an interior metal or plastic liner that fits inside the trash can, and which can be removed to be washed. However, these conventional trash cans still suffer from a number of drawbacks.

For example, the foot pedals on some of the conventional trash cans are noisy to use. In particular, stepping on a foot pedal of a conventional trash can often result in a loud banging noise as the lid is forced open immediately, and releasing the step on the foot pedal will also result in another loud banging noise as the lid slams shut under the force of gravity and the weight of the lid. These banging actions also result in wear and tear to the contacting parts.

Thus, there remains a need for a trash can that overcomes the drawbacks identified above.

SUMMARY OF THE DISCLOSURE

It is an object of the present invention to provide a trash can assembly that reduces noise and wear when the foot pedal is actuated to open and close the lid.

In order to accomplish the objects of the present invention, there is provided a trash can assembly that has an outer shell having an enclosing wall, a top end, and a bottom end. The assembly includes a pedal bar pivotably coupled to the bottom end, a lid pivotably coupled to the top end, and a lifting rod that extends vertically inside the outer shell, with the lifting rod coupling the lid and the rear end of the pedal bar. An air damper is provided inside the outer shell and coupled to the rear of the pedal bar for applying an opposing force against the downward motion of the rear of the pedal bar.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

FIGS. 1-4B illustrate one embodiment of a trash can assembly 20 according to the present invention. The assembly 20 has an outer shell 22 and an inner liner (not shown) that is adapted to be retained inside the outer shell 22. The outer shell 22 is supported on a base 52. An upper support frame 32 can be secured to the opened top of the outer shell 22, and can be provided in a separate material (e.g., plastic) from the outer shell 22.

Figure 1:
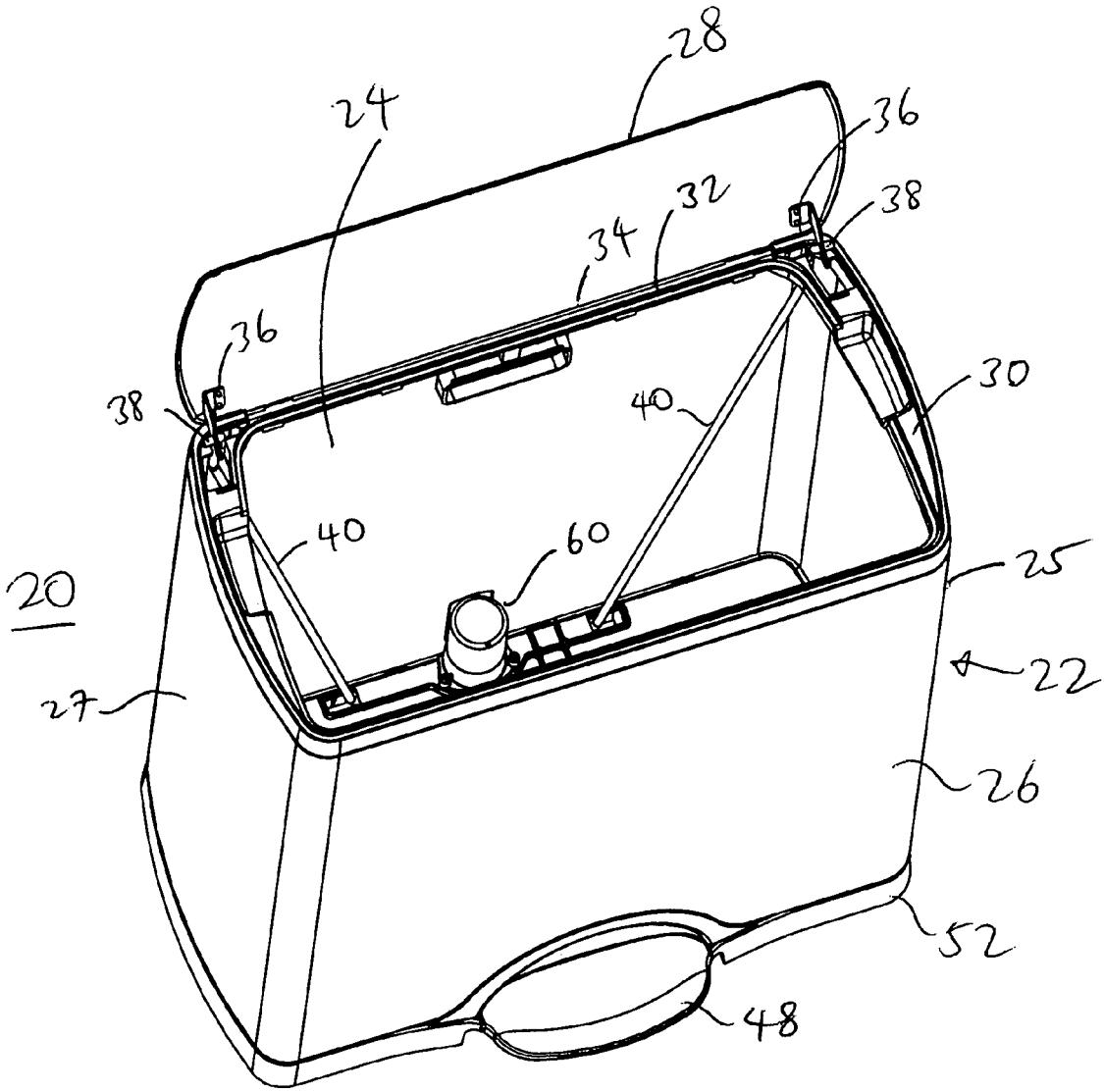
FIG. 1 is a front perspective view of a trash can assembly according to one embodiment of the present invention shown with the lid opened.

The outer shell 22 can assume any configuration. As a non-limiting example, FIG. 1 illustrates the outer shell 22 as having a generally four-sided configuration with a rear wall 24, a front wall 26, and two side walls 25, 27. The inner liner can have the same, or different, shape as the outer shell 22. A lid 28 is pivotably connected to a top edge of the rear wall 24 via a shaft (not shown) that is retained inside a sleeve 32. The sleeve 32 extends along an inner edge 34 of the lid 28. The shaft has opposing ends that are pivotably secured to the upper support frame 30, so that the lid 28 can pivot about an axis defined by the shaft and its corresponding sleeve 32. Two L-shaped brackets 36 are provided on the bottom surface of the lid 28 at opposite sides of the lid 28 adjacent the sleeve 32. One leg of each bracket 36 is secured to the underside of the lid 28, and the other leg of each bracket 36 has an opening that is adapted to receive an upper hooked end 38 of a corresponding lifting rod 40. The outer shell 22 and its lid 28 can be made of a solid and stable material, such as a metal.

Referring also to FIGS. 2A-4B, a foot pedal 48 is secured to (or made in one piece with) a pedal bar 50 that is pivotably coupled to the base 52 (e.g., using a fulcrum rod, as is well known in the art) at a pivoting axis 54 that is located at about the center of the pedal bar 50. The pedal bar 50 can be made of a material (e.g., metal) that carries some weight, or can be made from a lightweight material (e.g., plastic). The front of the pedal bar 50 is connected to the foot pedal 48, and the length of the pedal bar 50 extends along the base 52, with the rear of the pedal bar 50 pivotably coupled to the lifting rods 40 that extend upwardly along the rear of the outer shell 22 to connect the lid 28. The hooked end 38 of each lifting rod 40 is provided at the top end of the corresponding lifting rod 40 for coupling to the corresponding bracket 36.

Figure 2B:
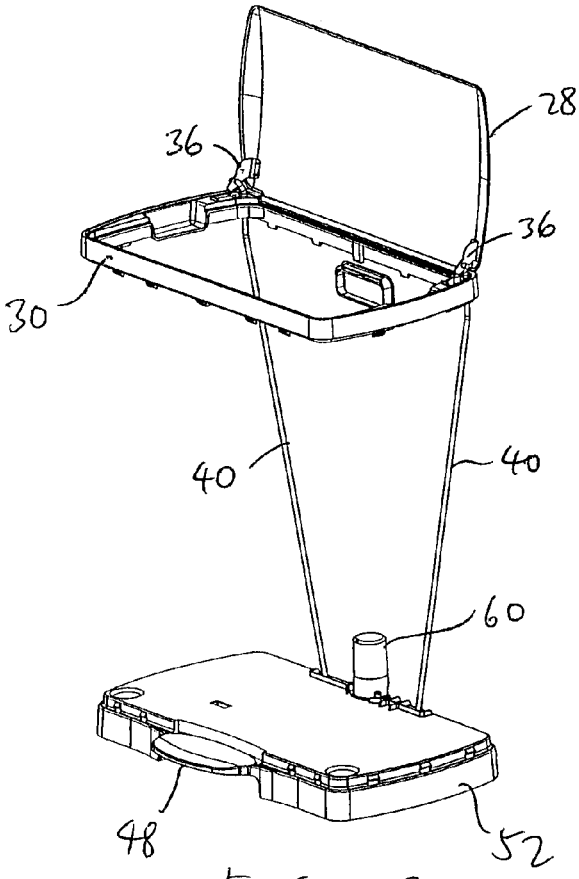
FIG. 2B is a front perspective view of the link assembly of the trash can assembly of FIG. 1 with the lid completely opened.
Figure 2A:
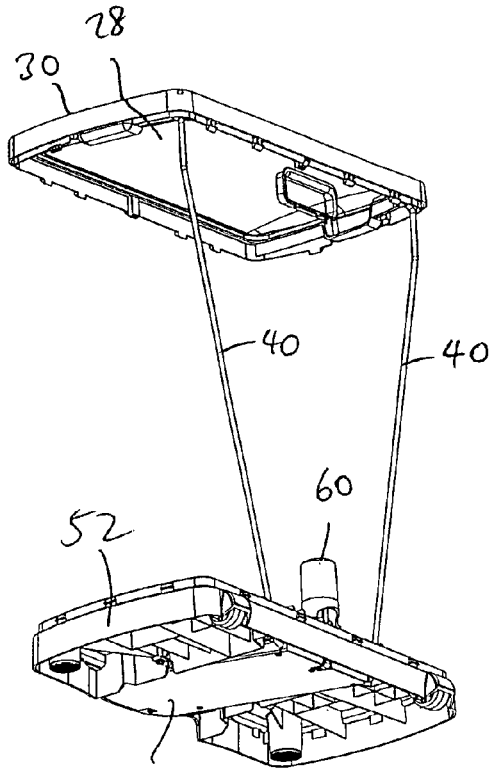
FIG. 2A is a rear perspective view of the link assembly of the trash can assembly of FIG. 1 with the lid closed.
Figure 3A:
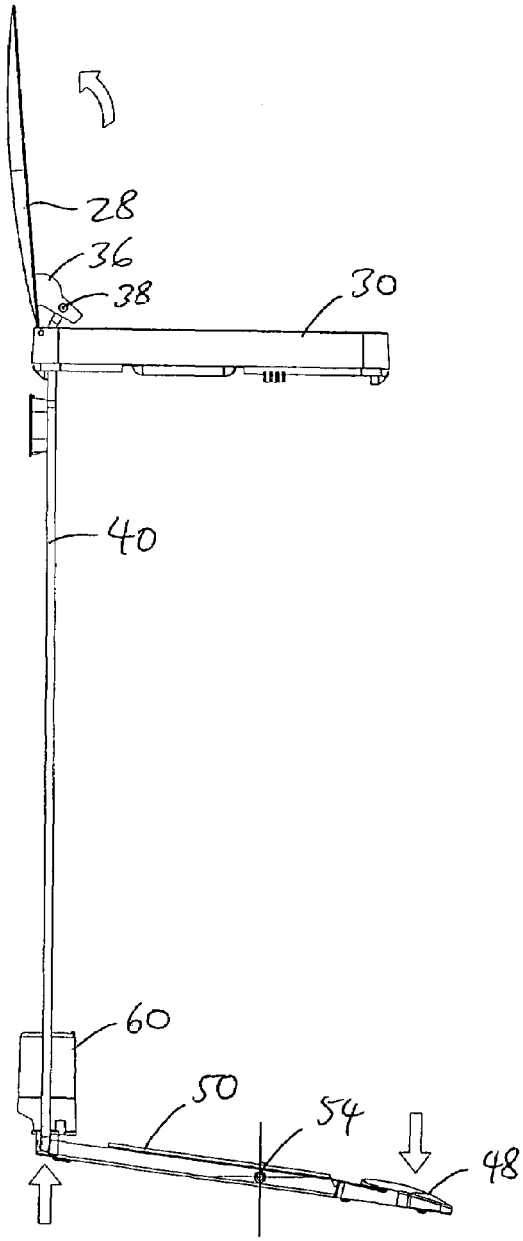
FIG. 3A is a side plan view of the link assembly of the trash can assembly of FIG. 1 with the lid opened.
Figure 4A:
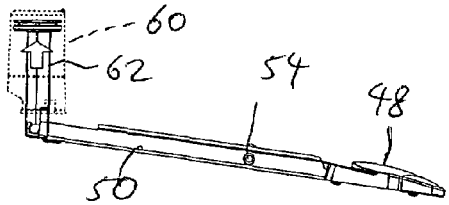
FIG. 4A is a cross-sectional view of the pedal bar and damper housing of the trash can assembly of FIG. 1 when the lid is opened.
Figure 3B:
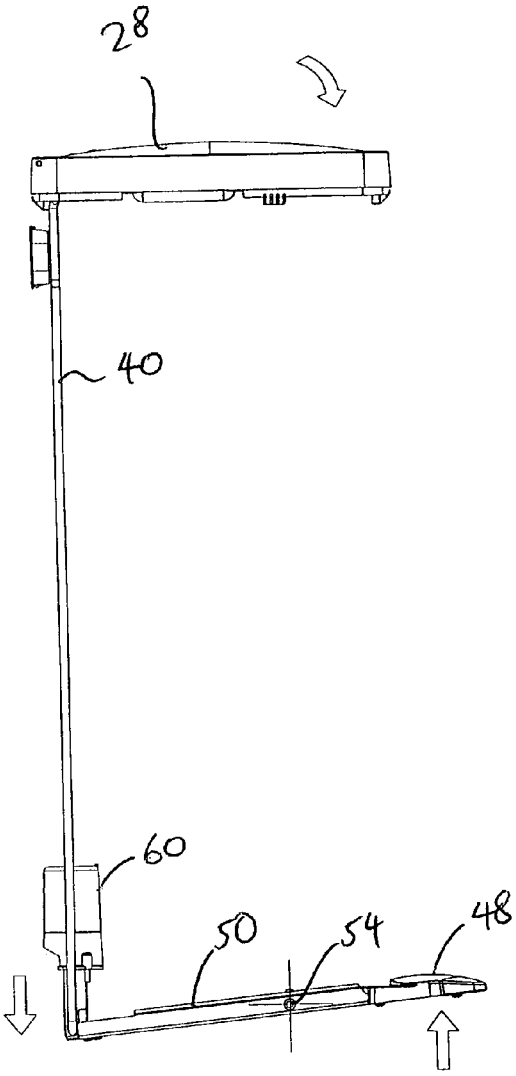
FIG. 3B is a side plan view of the link assembly of the trash can assembly of FIG. 1 with the lid closed.
Figure 4B:
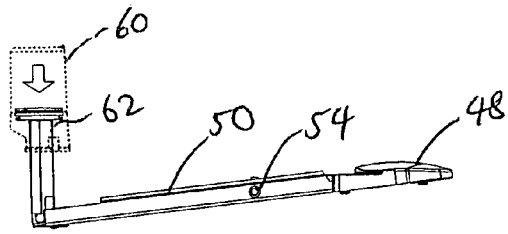
FIG. 4B is a cross-sectional view of the pedal bar and damper housing of the trash can assembly of FIG. 1 when the lid is closed.

The pedal bar 50 and the lifting rods 40 operate to translate an up-down pivot motion of the pedal 48 to an up-down pivot motion for the lid 28. In particular, the pedal bar 50 can be pivoted between two positions, a first rest position as shown (where the lid 28 is closed) in FIGS. 2A, 3B and 4B, where the foot pedal 48 at the front of the pedal bar 50 is at a vertically higher position than the rear of the pedal bar 50, and a second open position (where the lid 28 is completely opened) as shown in FIGS. 2B, 3A and 4A, where the foot pedal 48 is pressed to a vertically lower position than the rear of the pedal bar 50. In the second opened position, the foot pedal 48 is pressed to cause the pedal bar 50 to pivot, causing the rear of the pedal bar 50 to be raised upwardly, thereby pushing the lifting rods 40 upwardly to cause the hooked end 38 to push the bracket 36 upwardly, which causes the lid 28 to open. When the foot pedal 48 is maintained in this second opened position, the hooked end 38 will continue to maintain the lid 28 in the opened position. When the force on the foot pedal 48 is removed, the combined forces from the eight of the lid 28 (if applicable), the weight of the pedal bar 50 (if applicable), and gravity, will push the lifting rods 40 downward, causing the pedal bar 50 to pivot to the first rest position. Unfortunately, these combined forces can be large enough to cause the lid 28 to slam shut very quickly. As a result, the present invention provides a mechanism for slowing this closing motion of the lid 28, which focuses on slowing the downward motion of the rear of the pedal bar 50.

Referring to FIGS. 1-4B, a damper housing 60 is fixedly secured to the rear of the base 52 at about the center of the base 52. An air piston 62 is housed inside the damper housing 60, and is pivotably connected to the rear of the pedal bar 50. The air piston 62 functions to dampen or slow the closing motion of the lid 28.

Specifically, FIG. 4A illustrates the position of the air piston 62 inside the damper housing 60 when the lid 28 is completely opened. Referring also to FIG. 3A, in this opened position, the lifting rods 40 are raised by the bracket 36 and the lid 28, so that the rear of the pedal bar 50 is also raised with respect to the foot pedal 48 at the front of the pedal bar 50. When the rear of the pedal bar 50 is raised, the air piston 62 is pushed upwardly inside the damper housing 60 by the rear of the pedal bar 50 (see FIG. 4A). As the force on the foot pedal 48 is released, the combined forces from the weight of the lid 28 (if applicable), the weight of the pedal bar 50 (if applicable), and gravity, will push the lifting rods 40 downwardly. As the lifting rods 40 move downwardly (see FIG. 3B), the lifting rods 40 will push the rear of the pedal bar 50 downwardly, thereby pulling the air piston 62 downwardly within the damper housing 62 (see FIG. 4B). However, the drum of the air piston 62 positioned inside the damper housing 62 will oppose the immediate downward motion of the rear of the pedal bar 50, thereby slowing the downward motion of the lifting rods 40 and the lid 28.

When a force is applied to the foot pedal 48, the pedal bar 50 is pivoted again to cause the rear of the pedal bar 50 to be raised, thereby raising the lifting rods 40 and the lid 28 to the opened position shown in FIGS. 1, 2B, 3A and 4A. The air piston 62 is also pushed upwardly when the rear of the pedal bar 50 is raised, and does not apply any force to oppose its own upward motion inside the damper housing 60.

Thus, the present invention provides an air dampening mechanism (i.e., air piston 62) that slows the downward motion of the lifting rods 40, thereby slowing the closing motion of the lid 28. The structure of the air piston 62 is very simple, thereby reducing the cost of the trash can assembly while improving its performance and effectiveness.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A trash can assembly, comprising:

an outer shell having an enclosing wall and a top end;

a base supporting the outer shell;

a pedal bar pivotably coupled to the base, the pedal bar having a rear end;

a lid pivotably coupled to the top end;

a lifting rod that extends vertically inside the outer shell, the lifting rod coupling the lid and the rear end of the pedal bar; and an air damper provided inside the outer shell and coupled to the rear of the pedal bar for applying an opposing force against the downward motion of the rear of the pedal bar, the air damper comprising a housing mounted to the base.

2. The assembly of claim 1, wherein the lifting rod has an upper hooked end that is pivotably coupled to the lid.

3. The assembly of claim 1, wherein the air damper is positioned on top of the base.

4. The assembly of claim 1, wherein the air damper is positioned above the rear end of the pedal bar.

5. A method of slowing the closing motion of a lid of a trash can assembly, comprising:

a. providing a trash can assembly having:

an outer shell having an enclosing wall and a top end;

a base supporting the outer shell;

a pedal bar pivotably coupled to the bottom end, the pedal bar having a rear end;

a lid pivotably coupled to the top end, and operably coupled to the rear end of the pedal bar;

an air damper inside the outer shell and coupled to the rear of the pedal bar for applying an opposing force against the downward motion of the rear of the pedal bar, the air damper comprising a housing mounted to the base; and b. applying an opposing force against the downward motion of the rear of the pedal bar when the lid is being closed.

* * * * *

UNITED STATES PATENT AND TRADEMARK OFFICE

CERTIFICATE OF CORRECTION

PATENT NO. : 7,494,021 B2
APPLICATION NO. : 11/086932
DATED : February 24, 2009
INVENTOR(S) : Frank Yang and Joseph Sandor It is certified that error appears in the above-identified patent and that said Letters Patent is hereby corrected as shown below:

At column 3, line 15, please change “eight” to --weight--.

Signed and Sealed this

Thirtieth Day of June, 2009

JOHN DOLL
*Acting Director of the United States Patent and Trademark Office*